United States Patent [19]

Jautelat et al.

[11] Patent Number: 4,770,135

[45] Date of Patent: Sep. 13, 1988

[54] STARTING CONTROL FOR FUEL INJECTION SYSTEMS

[75] Inventors: Rüdiger Jautelat, Tamm; Rolf Kohler, Schwieberdingen; Günther Plapp, Filderstadt; Botho Zichner, Schwieberdingen, all of Fed. Rep. of Germany

[73] Assignee: Robert Bosch GmbH, Stuttgart, Fed. Rep. of Germany

[21] Appl. No.: 81,460

[22] PCT Filed: Jun. 13, 1986

[86] PCT No.: PCT/DE86/00250

§ 371 Date: Jun. 25, 1987

§ 102(e) Date: Jun. 25, 1987

[87] PCT Pub. No.: WO87/02741

PCT Pub. Date: May 7, 1987

[30] Foreign Application Priority Data

Oct. 25, 1985 [DE] Fed. Rep. of Germany ..... 3537996

[51] Int. Cl.[4] ..... F02D 41/06; F02D 41/34

[52] U.S. Cl. ..... 123/179 L; 123/491

[58] Field of Search ..... 123/179 G, 179 L, 491, 123/478

[56] References Cited

U.S. PATENT DOCUMENTS

| | | | |
|---|---|---|---|
| 4,223,654 | 9/1980 | Wessel et al. | 123/358 |
| 4,432,325 | 2/1984 | Auracher et al. | 123/491 |
| 4,436,073 | 3/1984 | Miyagi | 123/491 |
| 4,438,748 | 3/1984 | Ikeura et al. | 123/491 |
| 4,469,072 | 9/1984 | Kobayashi et al. | 123/491 |
| 4,543,937 | 10/1985 | Amano et al. | 123/491 |
| 4,653,452 | 3/1987 | Sawada et al. | 123/491 |

*Primary Examiner*—Willis R. Wolfe

*Attorney, Agent, or Firm*—Michael J. Striker

[57] ABSTRACT

A starting control for fuel injection systems of internal combustion engines is suggested in which an injection time ($te_{VER}$), which is dependent on the engine starting temperature ($T_{MS}$), is determined in the starting phase. In the starting phase, this injection time ($te_{VER}$) follows the curve of special starting characteristic lines. A continuous transition to performance characteristics injection time ($te_{KF}$) is effected by means of a comparator. A smooth transition from the starting phase to normal operation is obtained in this way.

5 Claims, 1 Drawing Sheet

STARTING CONTROL FOR FUEL INJECTION SYSTEMS

BACKGROUND OF THE INVENTION

The invention relates to a starting control for fuel injection systems. In known starting controls a mixture is made available during the warming up period which is richer than that subsequent to the achievement of a determined operating temperature. Below a predetermined speed threshold, an additionally increased enrichment of the mixture can be effected which, when the speed threshold is exceeded, suddenly passes into another starting characteristic line which is appropriate for the enrichment of the mixture. Such a discontinuous transition can be particularly disruptive precisely in the warming up phase.

SUMMARY OF THE INVENTION

It is an object of the invention to provide an improved starting control for fuel injection systems, the advantage of which resides in that, in the starting phase, a continuous transition from the variable starting factor, which determines the injection quantity or the injection duration in the starting phase, can be effected at performance characteristics provided for normal operation, from which performance characteristics the injection time for normal operation can be derived as a function of the speed and throttle valve angle. A continuous comparison takes place between the two calculated injection times so that a smooth transition can take place from the special starting characteristic line to the aforementioned performance characteristics.

The starting factor can also be determined by means of comparing two factors, one of which is dependent on time, while the other is dependent on speed. The smaller of the two factors is transmitted as a starting factor by means of a comparator. In addition, these two factors are dependent on the engine starting temperature with respect to their initial value, wherein a reduction of the initial value of the starting injection time can be effected as the engine starting temperature increases. A favorable adaptation of the injection quantity to the respective operating state of the engine can be effected in this manner.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
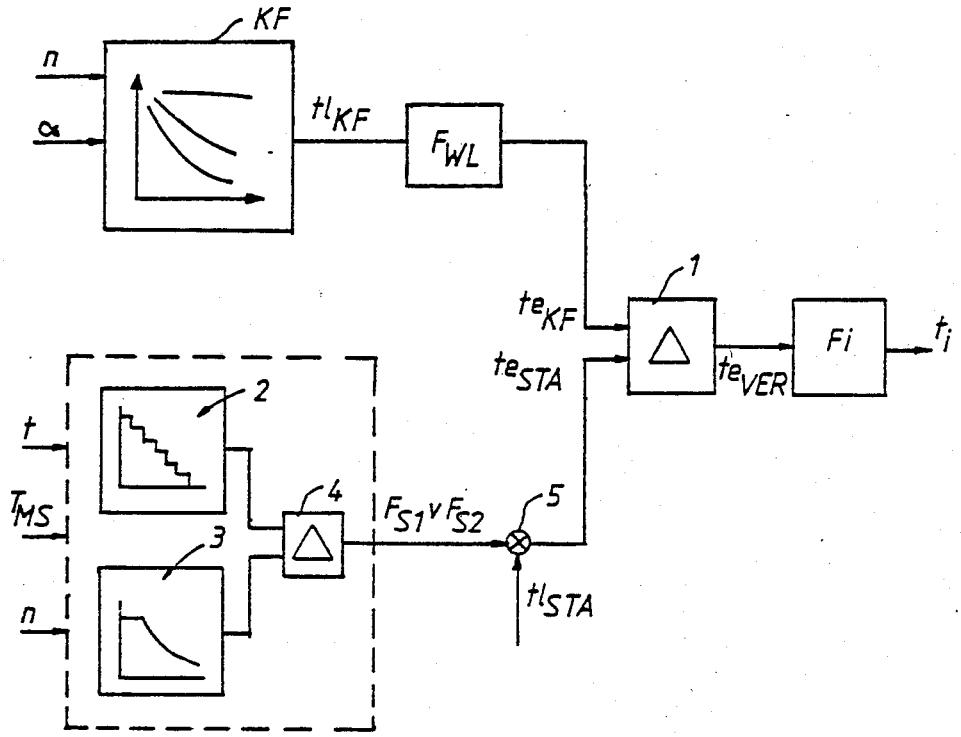
FIG. 1 shows an operational diagram of the starting control.

In the top part, the operational diagram shown in FIG. 1 contains performance characteristics KF, known per se, which give a basic injection time $t1_{KF}$ as a function of the speed n and the throttle valve angle $\alpha$. This value is processed further in order to determine the injection duration, wherein an evaluation can be effected with various factors as a function of the respective engine operating state. For example, an additional warming up factor $F_{WL}$ can be taken into consideration in the warming up phase so that a value $te_{KF}$ can be fed to the first input of a comparator 1 from the respective basic injection value $t1_{KF}$. A value $te_{STA}$, which is derived from special starting characteristic lines by means of multiplication by a quantization factor $t1_{STA}$, is fed to the other input of the comparator 1. The greater of the two values $te_{KF}$, $te_{STA}$ is transmitted to the device for determining the injection duration $t_i$ or the injection quantity at the output of the comparator 1 as injection time $te_{VER}$.

In order to determine the value $te_{STA}$ two starting characteristic lines 2, 3 are provided which give two factors $F_{S1}$, $F_{S2}$ to a comparator 4 which switches the smaller of the two factors through to the multiplier 5 at the output side.

Figure 2:
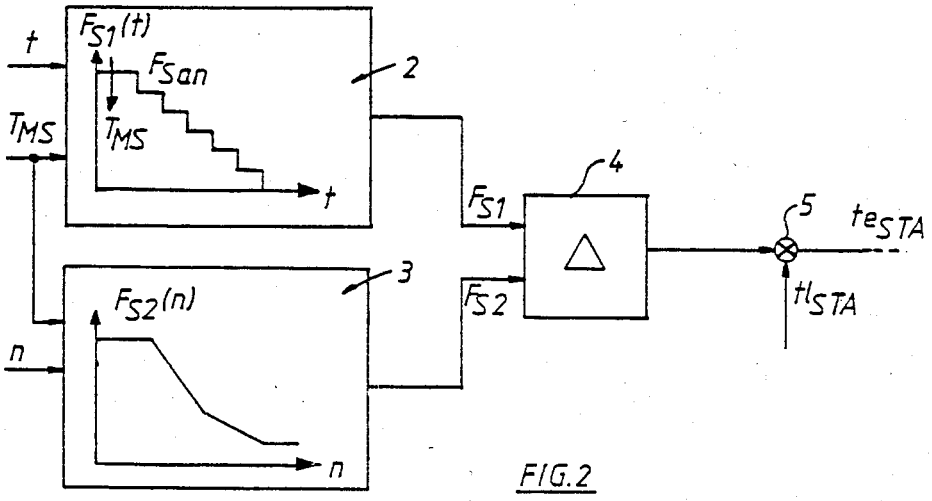
FIG. 2 shows a section of the starting control shown in FIG. 1.

The starting characteristic lines 2, 3 with the comparator 4 are shown more clearly in FIG. 2. The starting characteristic line 2 begins, as a function of the engine starting temperature $T_{MS}$, at an initial value $F_{San}$ and decreases in a stepwise manner by time t. With respect to its initial value, the first factor $F_{S1}$, resulting from this characteristic line 2, is dependent on the engine temperature and, otherwise, on the time. The second factor $F_{S2}$, which follows from the characteristic line 3, is likewise dependent on the engine temperature $T_{MS}$ with respect to its initial value and decreases as the speed n increases. The comparator 4 switches the smaller of the two factors $F_{S1}$, $F_{S2}$ through to its output and accordingly to the multiplier 5. The multiplication which is effected can be effected with a quantization factor $t1_{STA}=1.024$ ms, for example.

The stepwise time curve of the first factor $F_{S1}$ can be obtained in that the initial value $F_{San}$ is multiplied in constant time intervals by a factor which is slightly less than 1. The product resulting from the multiplication can then be periodically multiplied by the same factor.

We claim:

1. In a starting control for fuel injection systems of internal combustion engines, in which a variable injection factor, which is dependent on an engine starting temperature, is determined in a starting phase, which is ended when a starting speed is exceeded, in order to measure the injection time, the improvement comprising that a starting injection time ($te_{STA}$), which is dependent on the engine temperature ($T_{MS}$) and at least the time (t) and the engine speed (n) is compared with a performance characteristics injection time ($te_{KF}$) which is dependent on the engine speed (n) and the throttle valve angle ($\alpha$), and the larger of the two is defined as the injection time ($te_{VER}$), wherein the starting injection time ($te_{STA}$) is selectively derived from the smaller one of two factors ($F_{S1}$, $F_{S2}$), one of which is a time-dependent factor ($F_{S1}$), while the other is a speed-dependent factor ($F_{S2}$).

2. Starting control according to claim 1, wherein the initial value ($F_{San}$) of the two factors ($F_{S1}F_{S2}$) is dependent on the engine starting temperature ($T_{MS}$) prevailing at the starting time, wherein the factors ($F_{S1}$·$F_{S2}$) decrease as the engine starting temperature ($T_{MS}$) increases.

3. Starting control according to claim 1, wherein the time-dependent factor ($F_{S1}$) decreases in constant time intervals in steps starting from its initial value ($F_{San}$).

4. Starting control according to claim 1, wherein the respective effective factor ($F_{S1}$; $F_{S2}$) is multiplied by a quantization factor ($t1_{STA}$).

5. Starting control according to claim 2, wherein the time-dependent factor ($F_{S1}$) decreases in constant time intervals in steps starting from its initial value ($F_{San}$).

* * * * *